US008074383B2

(12) United States Patent
McClanahan

(10) Patent No.: US 8,074,383 B2
(45) **Date of Patent: *Dec. 13, 2011**

(54) LOCK FOR SECURING WEAR PARTS TO EARTH-WORKING EQUIPMENT

(75) Inventor: Robert McClanahan, Milwaukie, OR (US)

(73) Assignee: Esco Corporation, Portland, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/464,245

(22) Filed: May 12, 2009

(65) Prior Publication Data

US 2009/0217556 A1 Sep. 3, 2009

Related U.S. Application Data

(62) Division of application No. 11/818,483, filed on Jun. 13, 2007, now Pat. No. 7,536,811.

(60) Provisional application No. 60/814,670, filed on Jun. 16, 2006.

(51) Int. Cl.
*A01B 39/20* (2006.01)
*E02F 9/28* (2006.01)

(52) U.S. Cl. ..... 37/455; 37/456; 172/772.5

(58) Field of Classification Search ..... 37/350–360, 37/450–460; 172/772, 772.5; 403/319, 320
See application file for complete search history.

(56) References Cited

U.S. PATENT DOCUMENTS

| | | | | |
|---|---|---|---|---|
| 4,413,432 | A | 11/1983 | Bierwith | |
| 4,433,496 | A | 2/1984 | Jones et al. | |
| 4,501,079 | A | 2/1985 | Hahn et al. | |
| 4,602,445 | A | 7/1986 | Nilsson | |
| 4,748,754 | A | 6/1988 | Schwappach | |
| 5,088,214 | A | 2/1992 | Jones | |
| 5,241,765 | A | 9/1993 | Jones et al. | |
| 5,311,681 | A | 5/1994 | Ruvang et al. | |
| 5,564,508 | A | 10/1996 | Renski | |
| 5,653,048 | A | 8/1997 | Jones et al. | |
| 6,729,052 | B2 | 5/2004 | Ollinger, IV et al. | |
| 6,735,890 | B2 | 5/2004 | Carpenter et al. | |
| 6,993,861 | B2 | 2/2006 | Carpenter et al. | |
| 7,144,183 | B2 | 12/2006 | Lian et al. | |
| 7,171,771 | B2 | 2/2007 | Briscoe | |
| 7,174,661 | B2 | 2/2007 | Briscoe | |
| 7,367,144 | B2 | 5/2008 | Jones et al. | |
| 2003/0024139 | A1 | 2/2003 | Jones et al. | |
| 2004/0037637 | A1 | 2/2004 | Lian et al. | |
| 2004/0216336 | A1 * | 11/2004 | Briscoe | 37/455 |
| 2004/0237354 | A1 * | 12/2004 | Emrich | 37/450 |
| 2007/0044349 | A1 | 3/2007 | McClanahan et al. | |
| 2008/0092413 | A1 | 4/2008 | McClanahan et al. | |

FOREIGN PATENT DOCUMENTS

| | | |
|---|---|---|
| DE | 32 23 302 | 12/1983 |
| FR | 1 382 310 | 12/1964 |
| GB | 836 167 | 6/1960 |

* cited by examiner

*Primary Examiner* — Robert Pezzuto
*Assistant Examiner* — Jamie L McGowan
(74) *Attorney, Agent, or Firm* — Steven P. Schad

(57) ABSTRACT

A lock for securing a wear part to earth-working equipment that is foldable between a retaining position to hold the wear part to the equipment and a release position that permits removal of the lock and release of the wear part from the equipment. The lock includes a retainer for releasably holding the lock in the retaining position. The retainer may comprise a threaded wedge received into a complementary threaded passage.

22 Claims, 13 Drawing Sheets

10
44
104
54
94
52
76
88
42
74
94
104
50
46
82
77
48
86
44
76
88
72
78
50
10
54
84
66
68
52
42
58
56
46
64
80
48
86
77
10
48
42
76
86
80
68
78
54
44
66
60
72
52
82
84
62
88
70
50

LOCK FOR SECURING WEAR PARTS TO EARTH-WORKING EQUIPMENT

The present application is a divisional of U.S. patent application Ser. No. 11/818,483 filed Jun. 13, 2007, which is now U.S. Pat. No. 7,536,811, and which is a non-provisional of U.S. Provisional Patent Application No. 60/814,670 filed Jun. 16, 2006.

FIELD OF THE INVENTION

The present invention pertains to locks for securing wear parts to earth-working equipment.

BACKGROUND OF THE INVENTION

Wear parts are commonly attached to earth-working equipment such as excavating buckets and the like. For example, teeth and shrouds are generally mounted along the digging edge of an excavating bucket to protect the bucket from wear and to enhance the digging operation. Such wear assemblies typically include a base, a wear member, and a lock to releasably hold the wear member to the base. The base is fixed to the equipment as an integral part of the equipment, or as one or more components that are fixed to the equipment by welding or mechanical attachment. The wear member fits over the base. The assembled base and wear member cooperatively define an opening into which the lock is received to releasably hold the wear member to the base.

Wear members for earth-working equipment are commonly subjected to harsh conditions and/or heavy loading. Accordingly, it is desirable for the lock to be strong to effectively retain the wear member to the equipment, resistant to ejection during use, and easily removed in the field when replacement of the wear part is needed. Many different lock arrangements have been designed in an effort to meet these objectives with varying degrees of success.

SUMMARY OF THE INVENTION

The present invention pertains to improved locks for securing wear parts to earth-working equipment that are strong, durable, resistant to ejection, easy to manufacture at reduced costs, and simple and safe to use.

In accordance with one aspect of the invention, the lock includes bodies that are interconnected for pivotal movement between a retaining position where the lock holds a wear part to the earth-working equipment and a release position where the lock permits release of the wear part from the equipment.

In accordance with one other aspect of the invention, the lock is hinged for movement between the retaining position and the release position. In the retaining position, the lock defines a robust pin that sets within an opening in the wear part to resist loads applied to the wear part during use. In the release position, the lock is articulated about the hinge to permit easy withdrawal or installation of the lock into or from the wear assembly, thus, permitting easy replacement of the wear part in the field.

In accordance with another aspect of the invention, the body of the lock includes end walls that are preferably shaped to cooperate with sides of the opening and thereby prevent ejection of the lock during use. As a result, retention of the lock is achieved by the strength of the pin itself and does not rely upon a movable latch, magnets, additional welding or other separate means that require additional parts and/or are more susceptible to ejection during use.

In accordance with one other aspect of the invention, the lock is made of two bodies that are coupled together by a hinge, which preferably is formed of components that are integral to the bodies. This construction reduces the number of components, eases manufacturing, reduces costs, and strengthens the lock. In one preferred embodiment, one lock component is formed with an integral post while the other lock component has a complementary hole.

In accordance with another aspect of the invention, the lock is foldable for insertion into and release from a wear assembly, and includes a retainer to prevent folding while in the retaining position to prevent loss of the lock and wear part during use.

In accordance with another aspect of the invention, the lock includes a retainer that is threaded into a passage engaging both components. The retainer may have many different configurations. As examples only, the retainer may extend into both components, may be inserted along a seam between the components, and may extend in one of a multiple of directions. The retainer may also be a threaded rod, wedge or set screw, or have other configurations resisting pivoting or folding of the lock. The retainer is preferably easy to use, and enables installation and removal without the need for hammering, which leads to a safer and easier replacement process.

In accordance with another aspect of the invention, the lock includes movable components that are fixed in the retaining position by a threaded wedge.

In accordance with one other aspect of the invention, the lock is provided with means for effecting articulation and removal of the lock from the wear assembly. In one construction, the lock includes a grip to be engaged by a tool for manipulating the lock. In alternative construction, the lock is provided with a driver that articulates the lock for removal. In one preferred construction, the driver is threaded through one of the bodies to press against the assembly and move the lock into its articulated release position.

DETAILED DESCRIPTION OF THE PREFERRED EMBODIMENTS

Figure 1:
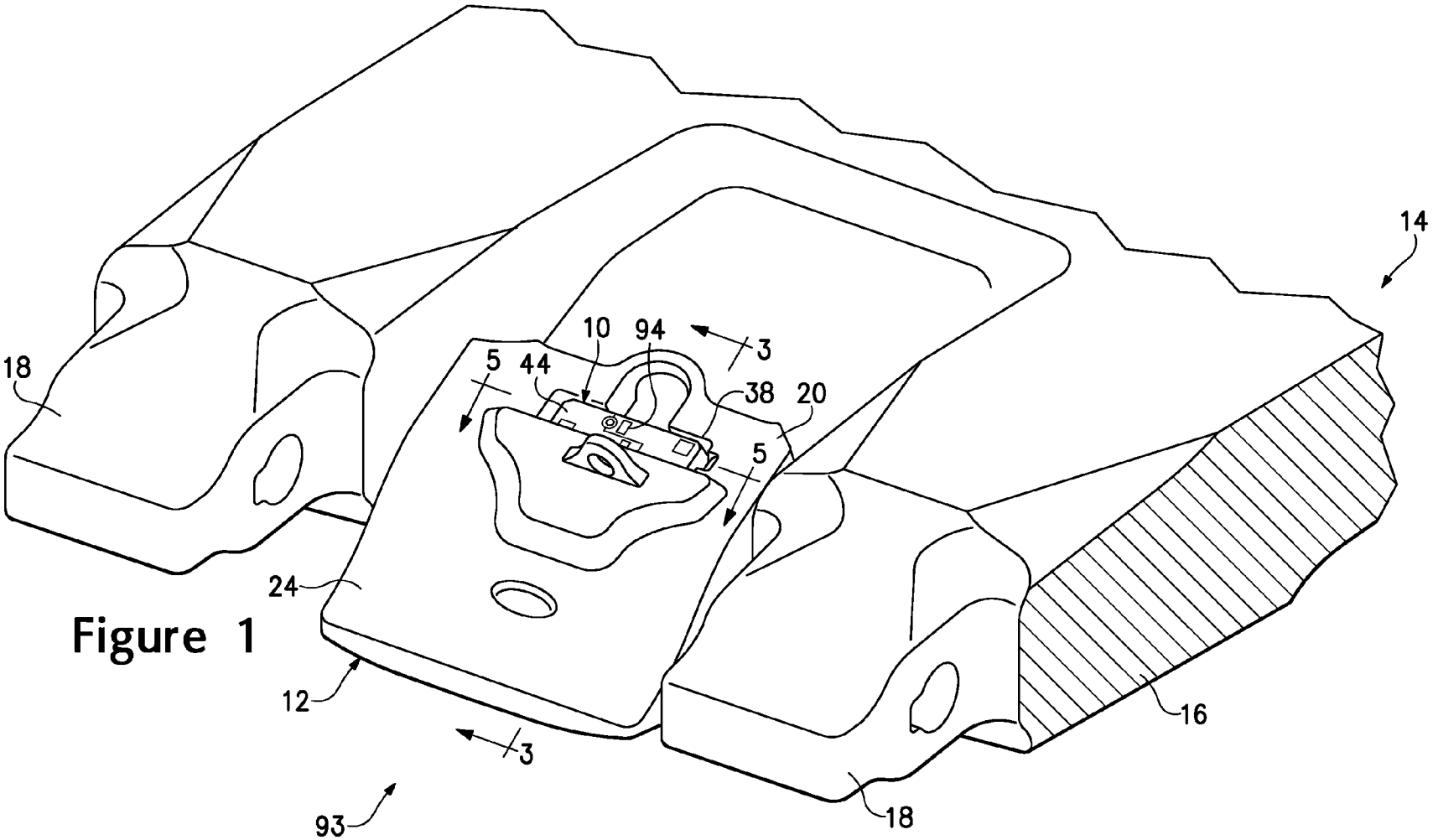
FIG. 1 is a perspective view of a wear assembly wherein the wear part is a shroud secured to a lip of an excavating bucket with lock in accordance with the present invention (the lip being only partially shown).

The present invention pertains to a lock 10 for releasably securing a wear member 12 to earth-working equipment 14. To illustrate the invention in this application, lock 10 is described in the context of securing a shroud to a lip of an excavating bucket. As an example, the disclosed shroud is generally as described in U.S. Patent Application Publication No. 2007-0044349, which is incorporated by reference. Nevertheless, a lock in accordance with the present invention could be used to secure other wear members including, for example, (i) other shrouds (e.g., as disclosed in U.S. Pat. No. 5,088,214, which is incorporated by reference), (ii) excavating teeth (e.g., as disclosed in U.S. Pat. No. 5,653,048, which is incorporated by reference), (iii) runners or other wear members for buckets (e.g., as disclosed in U.S. Pat. No. 5,241,765, which is incorporated herein by reference), (iv) wear members for other kinds of excavators such as dredge cutterheads (e.g., as disclosed in U.S. Pat. No. 6,729,052, which is incorporated herein by reference), and (v) wear members for other kinds of earth-working equipment used in connection with excavating operations such as ore chutes, truck bed liners, etc. Additionally, relative terms such as forward, rearward, up or down are used for convenience of explanation with reference to FIG. 1; other orientations are possible.

In one embodiment of the invention (FIGS. 1-11), shroud 12 fits onto lip 16 between two noses 18 (FIGS. 1-3) that support excavating points (not shown). In a preferred construction, lip 16 includes an insert 25 that is fixed into place via welding 32. The insert defines a boss 26 near the front edge 27 of the lip for securing shroud 12. The lip, of course, could have many different constructions and could include this boss (or another kind of base) without the use of an insert.

Shroud 12 includes a pair of legs 20, 22 to straddle lip 16, and a wearable front end 24 (FIGS. 1-4). Leg 20 includes a recess 34 along its inner surface 36 to receive boss 26, and an opening 38 through the leg to receive lock 10. The lock fits within opening 38 and extends below the leg to oppose rear face 40 of boss 26 to hold the shroud in place; i.e., with lock 10 in opening 38, the shroud cannot be pulled from the lip due to the abutment of lock 10 against boss 26.

Figure 5:
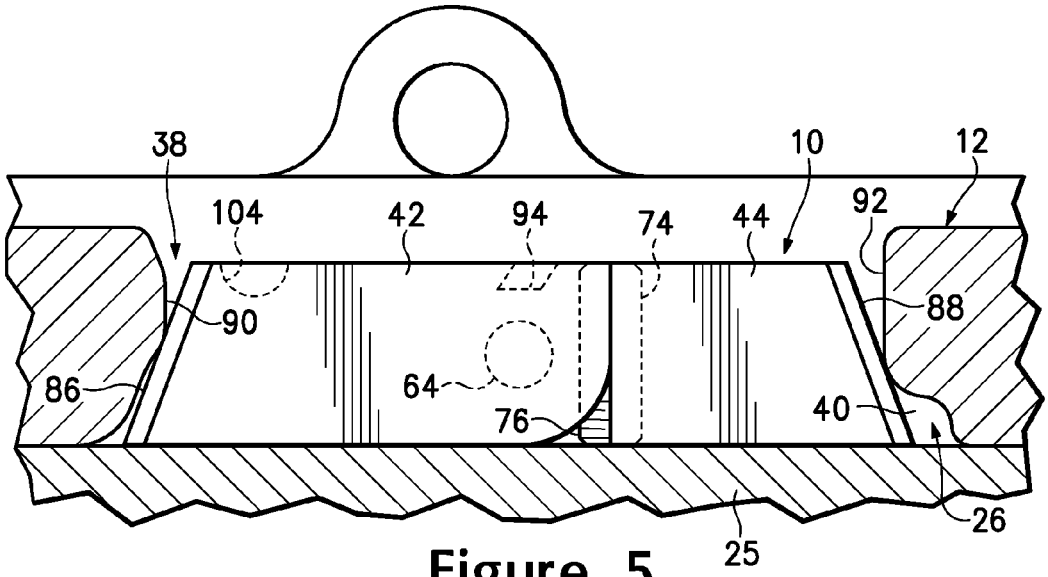
FIG. 5 is a cross-sectional view taken along line 5-5 in FIG. 1.
Figure 6:
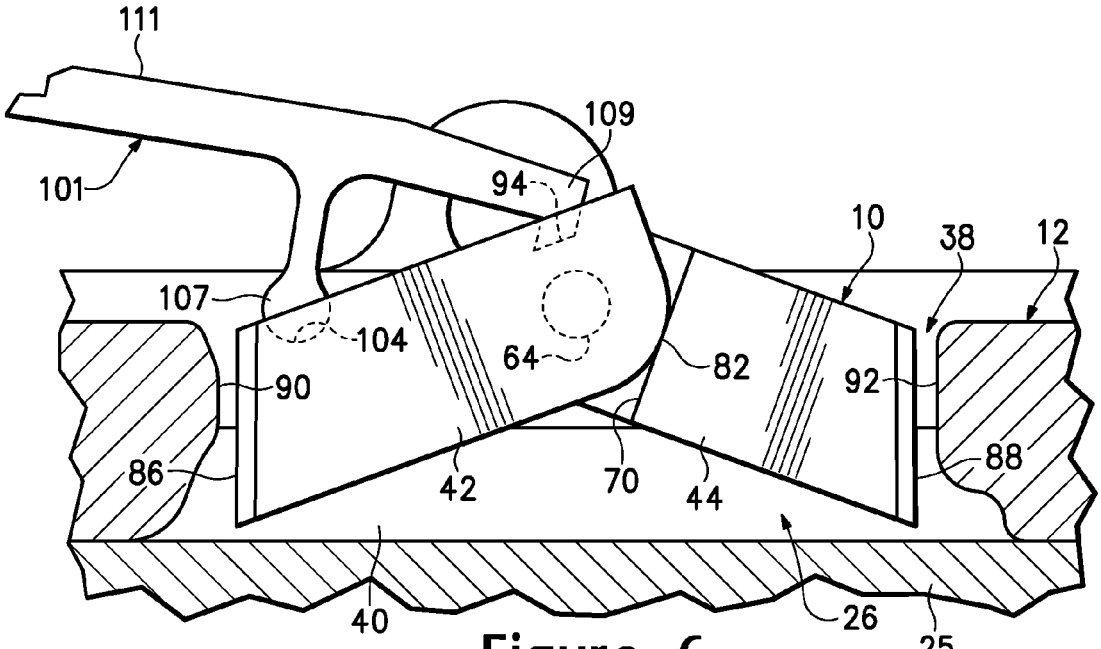
FIG. 6 is a cross-sectional view also taken along line 5-5 in FIG. 1, but with the lock in an articulated release position for removal from the assembly.
Figures 7, 8, 9:
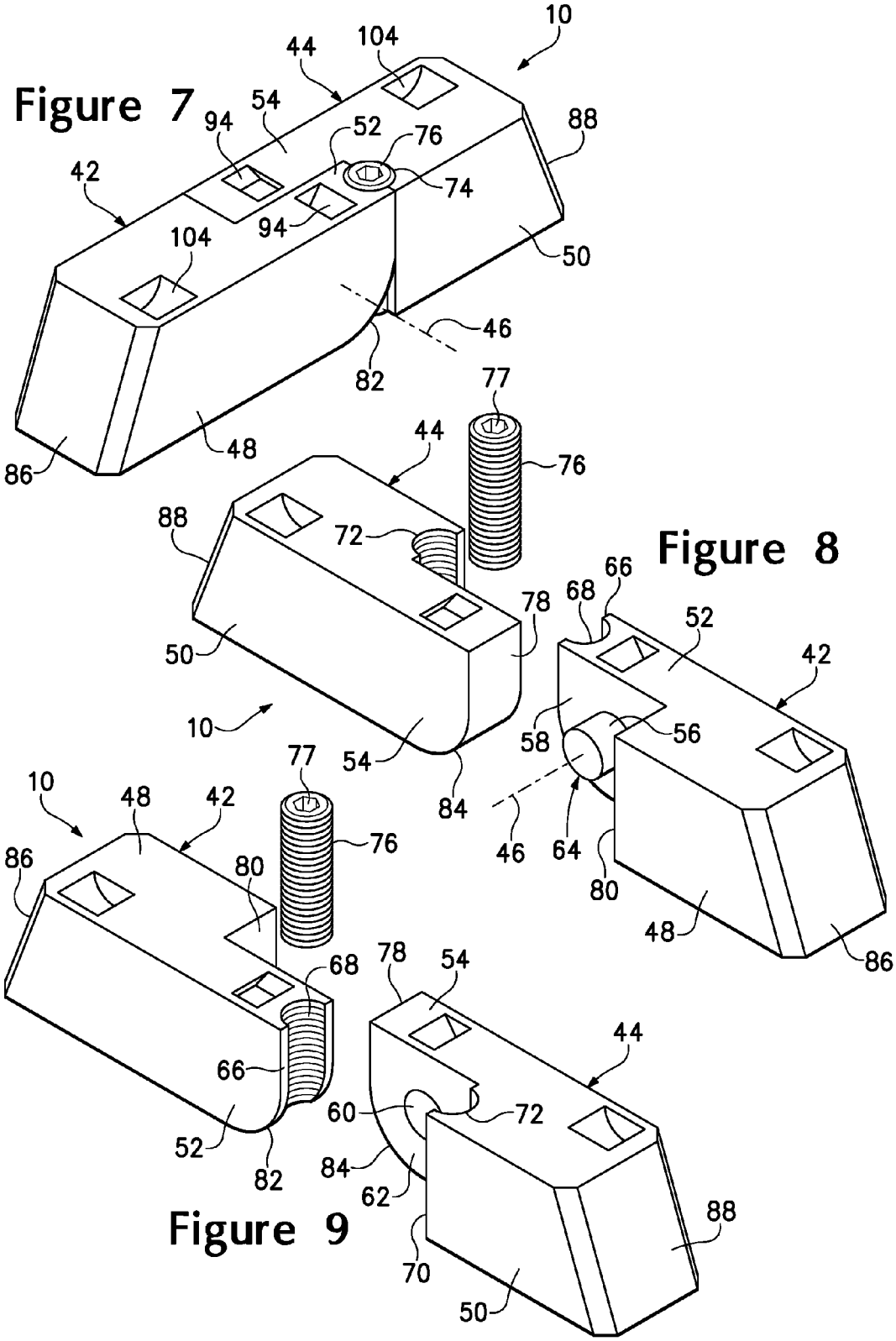
FIG. 7 is a perspective view of the lock in a locking position.
FIGS. 8 and 9 are exploded perspective views of the lock.
Figure 10:
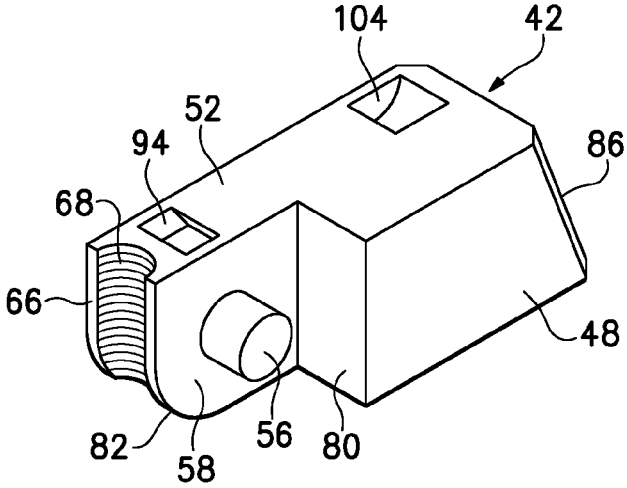
FIGS. 10 and 11 are each a perspective view of one of the components of the lock.
Figure 11:
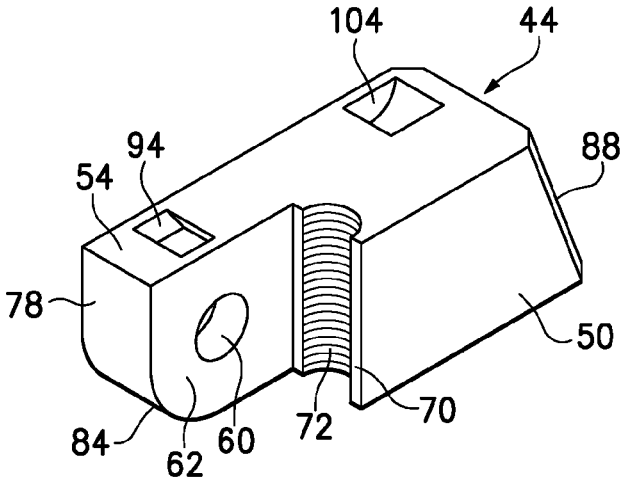

Lock 10 includes two bodies or components 42, 44 that are pivotally coupled together for movement about a lateral axis 46 between a retaining position (FIGS. 5 and 7) and a release position (FIG. 6). In a preferred construction, each body 42, 44 has a generally L-shaped configuration with a base portion 48, 50, and a projection 52, 54 (FIGS. 5-10), although other shapes can be used. In the illustrated example, first body 42 includes an integral post 56 projecting from an inner face 58 of projection 52. The second body 44 includes a complementary hole 60 in the inner face 62 of projection 54. The post is received within hole 60 to form a hinge 64 that pivotally couples first and second bodies 42, 44 together for limited movement about axis 46. Alternatively, the hinge could have other constructions including, for example, forming each projection with a hole for receiving a pivot pin secured in place by retaining rings or the like.

Each body 42, 44 is formed with a threaded channel 68, 72. Channel 68 is formed on free end 66 of projection 52, and channel 72 is formed on front surface 70 of base portion 50. When bodies 42, 44 are assembled together and in the retaining position, free end 66 sets opposed to front surface 70 so that channels 68, 72 are aligned with each other to collectively form a passage 74. Preferably, each channel 68, 72 defines, in lateral cross-section, a semi-circle so that the two channels collectively form a complete circular passage, though less than a full semi-circle for each or one channel is possible. Preferably both channels 68, 72 are formed with thread segments to cooperatively define a threaded passage 74. Nevertheless, the channels could be partially threaded or threads provided along only one channel.

A retainer 76 in the form of a threaded rod is threaded into passage 74 with lock 10 in the retaining position to prevent relative movement between the two components 42, 44. A hex socket 77 or other tool engaging formation is provided at the top of retainer 76 for turning the retainer. With the retainer inserted in passage 74 (FIGS. 1, 3-5 and 7), bodies 42, 44 cannot be pivoted about axis 46. As a result, the lock presents a strong, integral pin to resist heavy loading and prevent release of shroud 12 from lip 16. When retainer 76 is removed, bodies 42, 44 can pivot about axis 46 from the retaining (or locked) position to the release position (FIG. 6). The bottom corners 82, 84 of free ends 66, 78 are rounded or otherwise shaped to provide sufficient clearance for components 42, 44 to pivot about axis 46 to the release position. Corners 82, 84 preferably abut against front faces 70, 80 of bodies 42, 44 in the release position to ease removal and installation of the lock.

Other alternatives are possible. For example, threaded channels could be formed at the free end 78 of projection 54 and the front surface 80 of base portion 48. Also, as an alternative, the rod and passages could be unthreaded with the rod held in place by a detent, retainer clips or other securing devices. Additionally, other retainers could be used to prevent pivotal movement between bodies 42, 44. For example, other plates or rods could extend through the bodies in different directions and/or at different locations to prevent relative movement between the bodies 42, 44. In addition, the lock could be maintained in the retaining position by an external member or structure that forms part of the assembly but may not be part of the lock. Also, other hinge and retainer constructions could be used to provide sufficient strength, enable articulation for insertion and removal, and allow access for the retainer.

Also, while bodies 42, 44 are disclosed as having the same or similar lengths and forming opposite ends of the lock, other arrangements could be used. For example, the bodies could have different lengths or each extend the full length of the lock. Also, the lock could comprise a foldable element, but not consist of two components joined by a pivot pin. Other arrangements could be used to present a firm, secure lock in the retaining position, but which permits folding of the lock to the release position. In each of these different ways, the lock possesses a shorter length in the release position than in the retaining position so that it is only released when desired.

Figure 2:
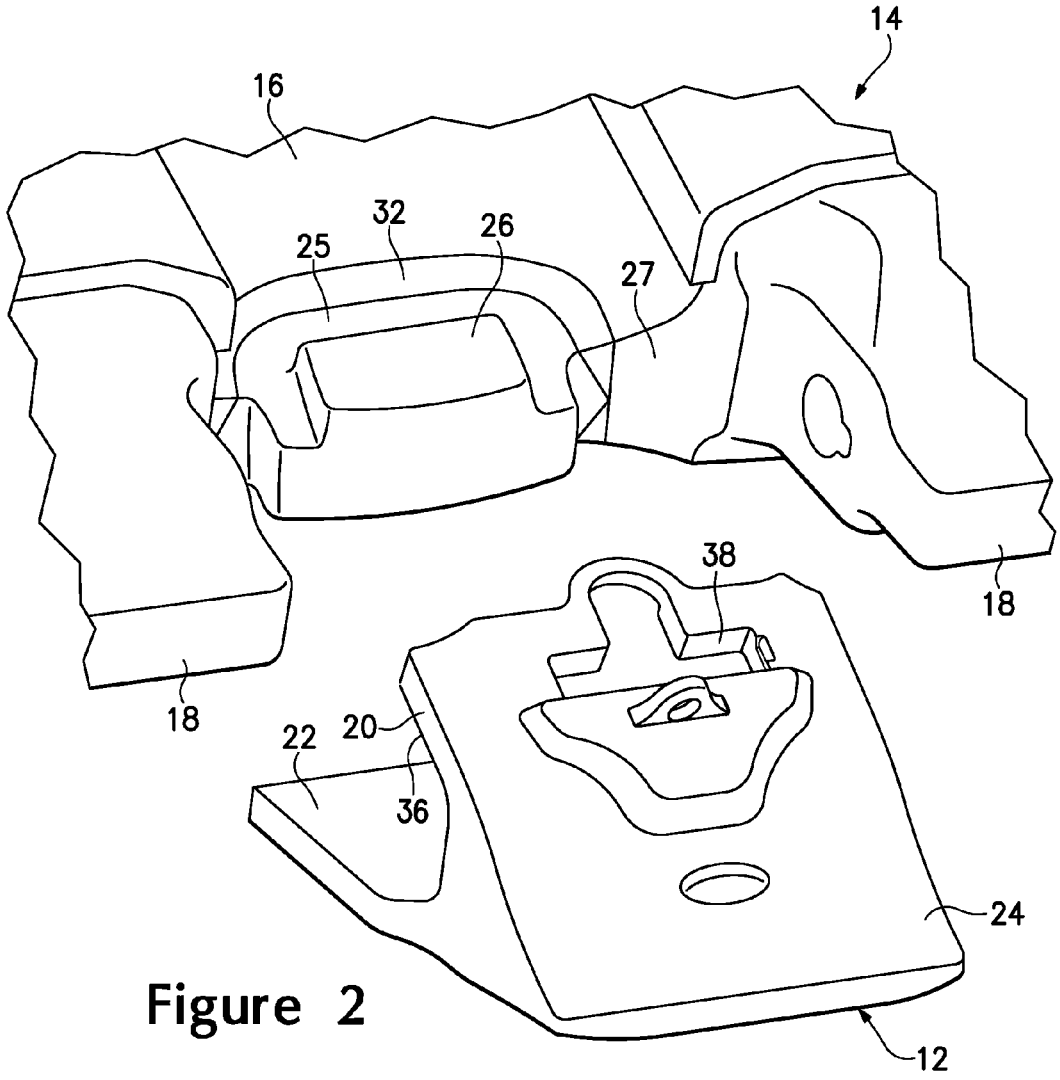
FIG. 2 is an exploded perspective view of the wear assembly of FIG. 1 without the lock.
Figure 3:
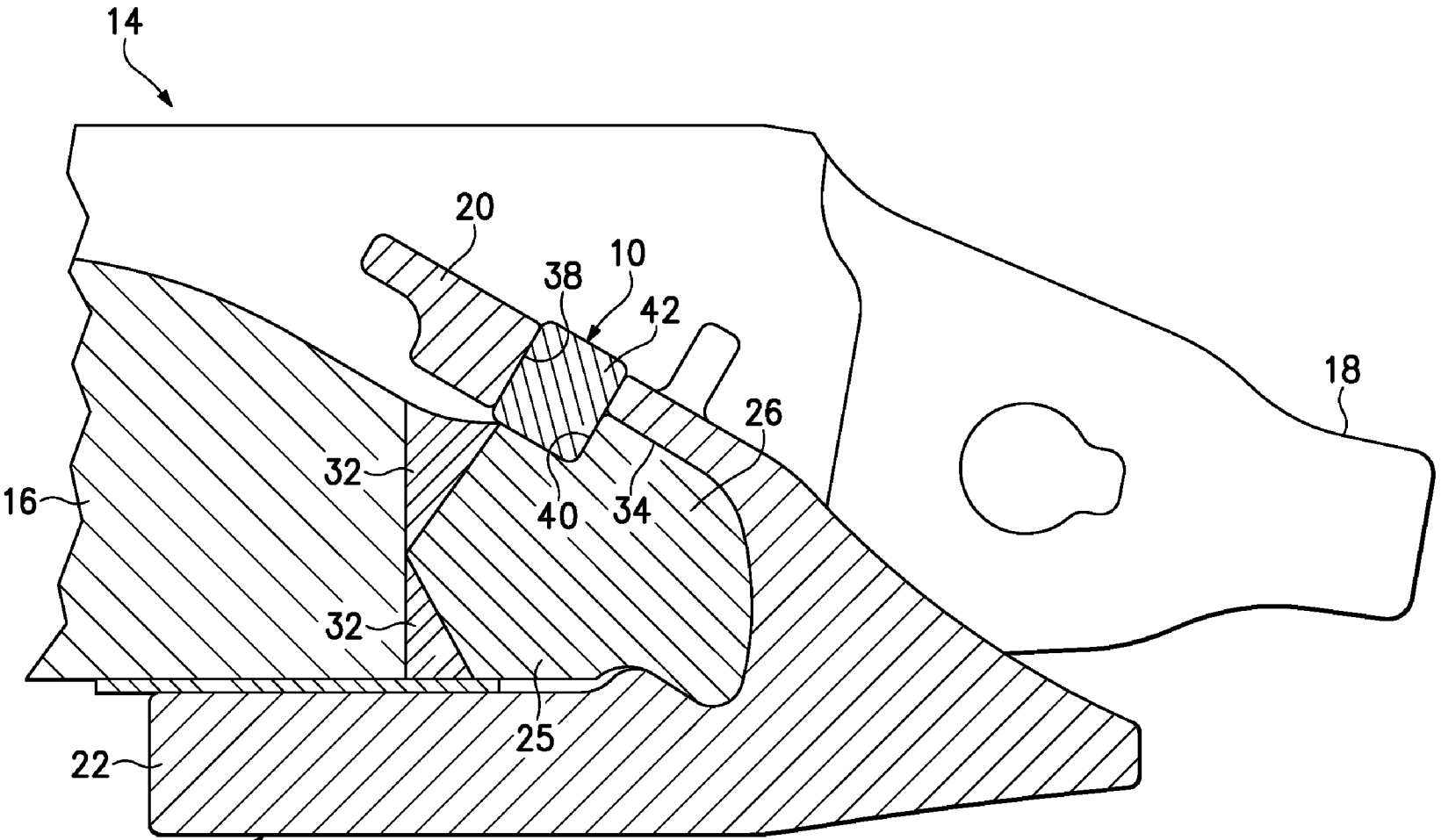
FIG. 3 is a cross-sectional view taken along line 3-3 in FIG. 1.
Figure 4:
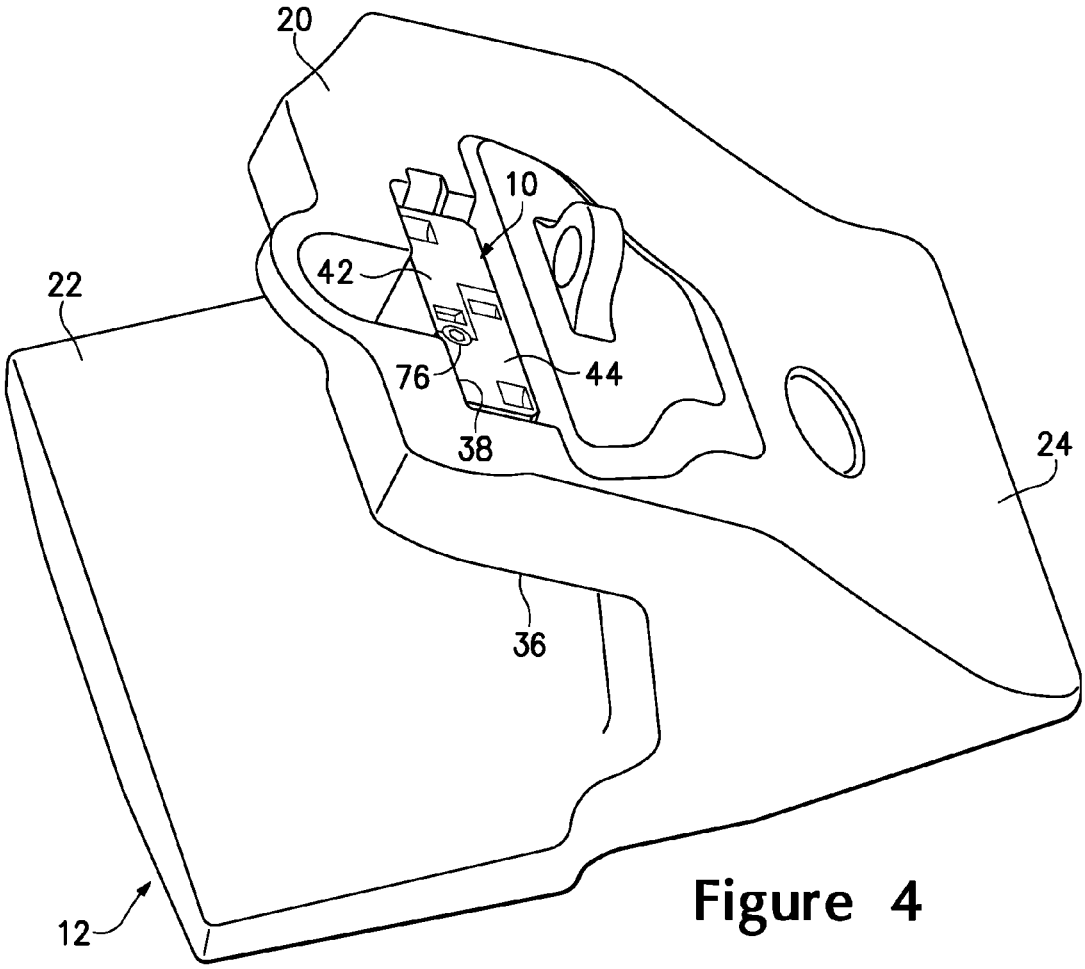
FIG. 4 is a perspective view of the wear part of FIG. 1 with the lock in place.

During use, lock 10 fits in opening 38 of shroud 12 (FIGS. 1, 3 and 5). The end walls 86, 88 of bodies 42, 44 are inclined downward and outward to fit under the end walls 90, 92 of opening 38 (FIG. 5). This fit precludes removal or ejection of the lock when retainer 76 is in passage 74. Nevertheless shaped walls such as stepped walls, walls with projections, or otherwise shaped end walls 86, 88 could be used to secure the lock in place. As an alternative, latches, detents, magnets, obstructions or other means could be used to hold lock 10 in opening 38.

To replace a worn shroud, lock 10 must first be removed. To do so, retainer 76 is unthreaded from passage 741 and bodies 42, 44 pivoted about axis 46 to their release position (FIG. 6). In this position, end walls 86, 88 of the lock clear end walls 90, 92 of the opening so that the lock can be withdrawn from the wear assembly 93. At least one body 42, 44 (and preferably both to enable removal from either direction) is provided with a grip 94 to facilitate pivoting of the bodies and pulling the lock from the opening. In the preferred embodiment, grips 94 are formed as inclined cavities to receive a removal tool 101; although other forms of grips could be used. Each body 42, 44 also preferably includes a depression 104 spaced from grip 94 to stably support a fulcrum 107 of tool 101. In use, a gripping end 109 of tool 101 fits into cavity 94 on body 42 (or 44) with fulcrum 107 resting in one depression 104. The lever 111 of tool 101 is pushed downward to pull the middle of lock 10 upward such that the bodies 42, 44 pivot about hinge 64. In this position, the lock can be pulled out of opening 38 with tool 101. Once a new shroud is placed on lip 16, the bodies are manually manipulated into the release position and the lock dropped into opening 38. The bodies naturally extend into their locked position when placed in assembly 93. Retainer 76 can then, again, be threaded into passage 74 to retain bodies 42, 44 in the retaining position (FIGS. 1 and 5).

Figure 12:
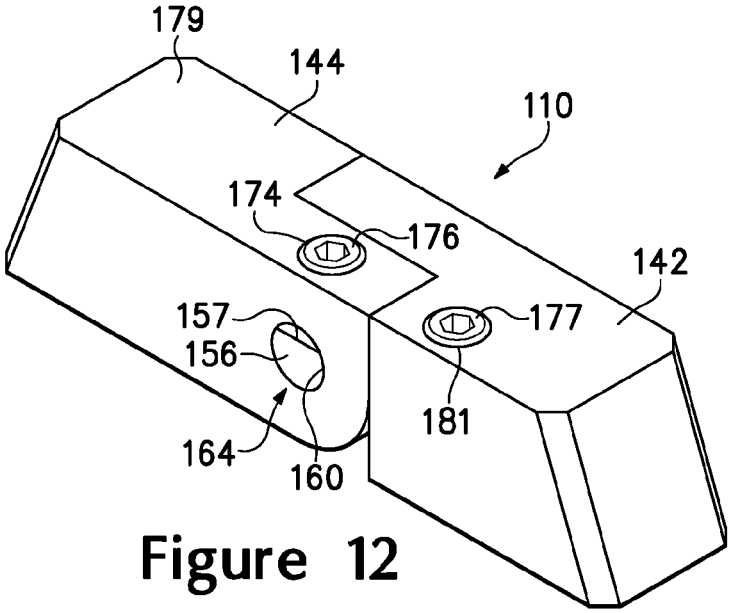
FIG. 12 is a perspective view of an alternative lock construction in accordance with the present invention.
Figure 13:
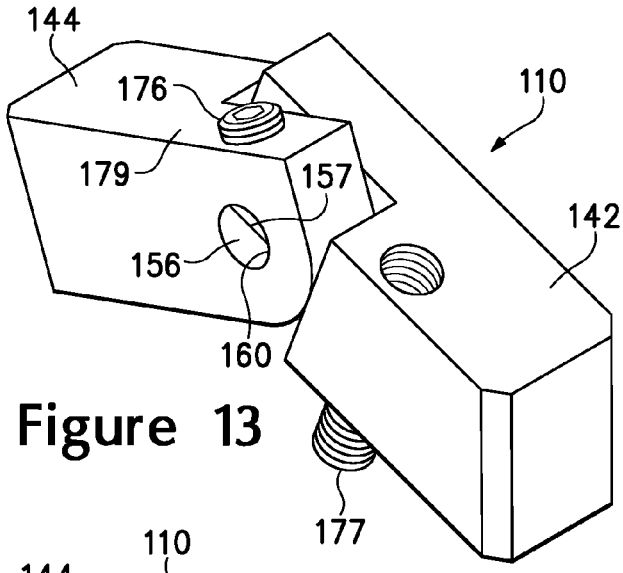
FIG. 13 is a perspective view of the alternative lock in the release position.
Figure 14:
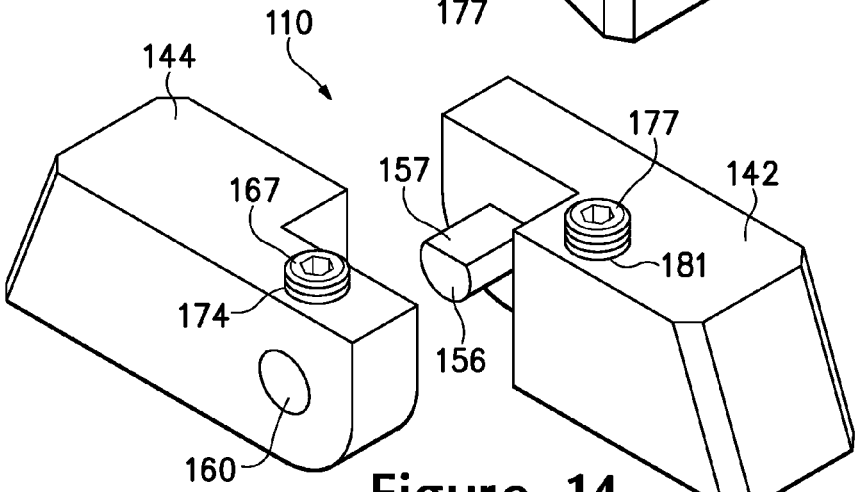
FIG. 14 is an exploded, perspective view of the alternative lock.
Figure 15:
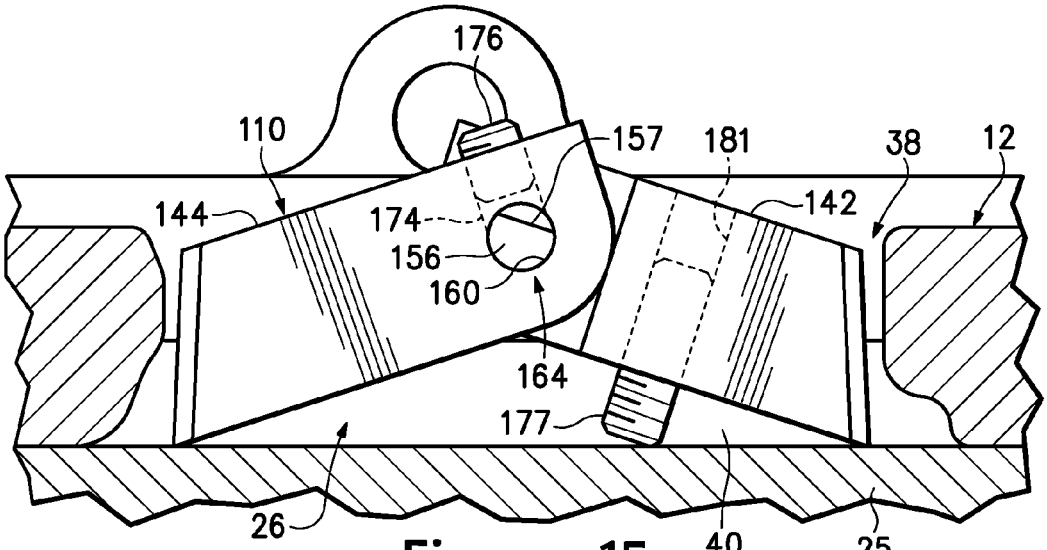
FIG. 15 is a cross-sectional view along line 5-5 in FIG. 1, but of the alternative lock in the release position.
Figure 16:
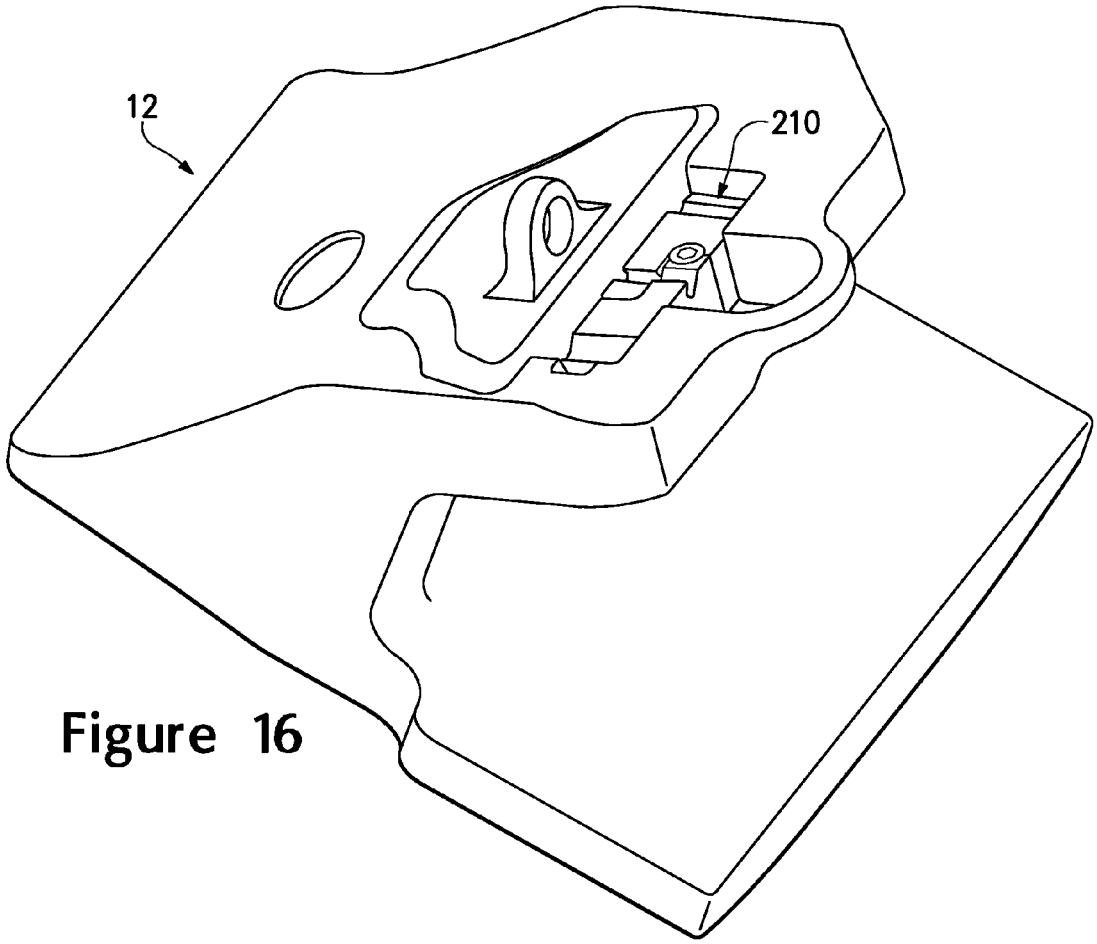
FIG. 16 is a perspective view of a wear assembly wherein the wear part is a shroud securable to a lip of an excavating bucket with a second alternative lock in accordance with the present invention.
Figure 17:
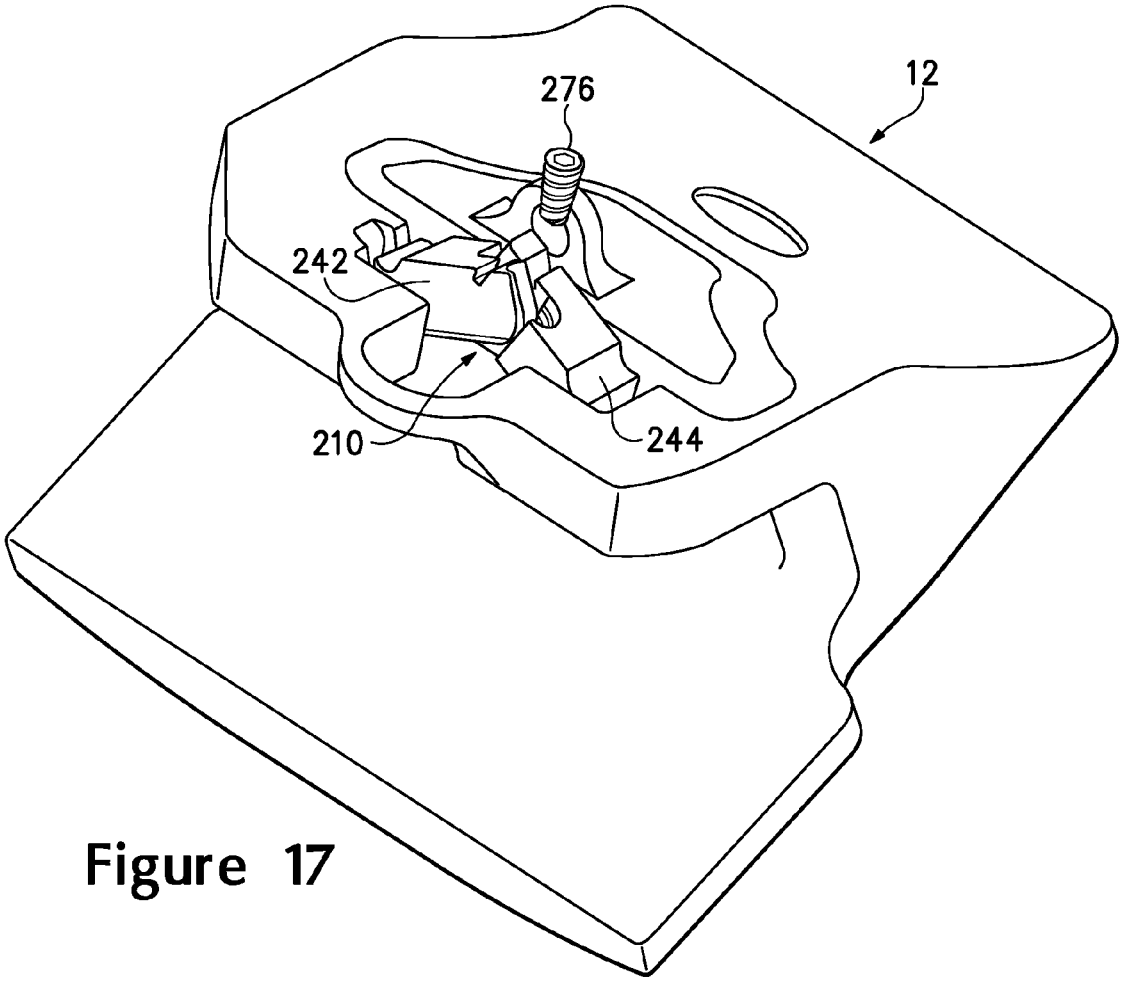
FIG. 17 is a perspective view of the wear assembly of with the second alternative lock shown in a release position.
Figure 18:
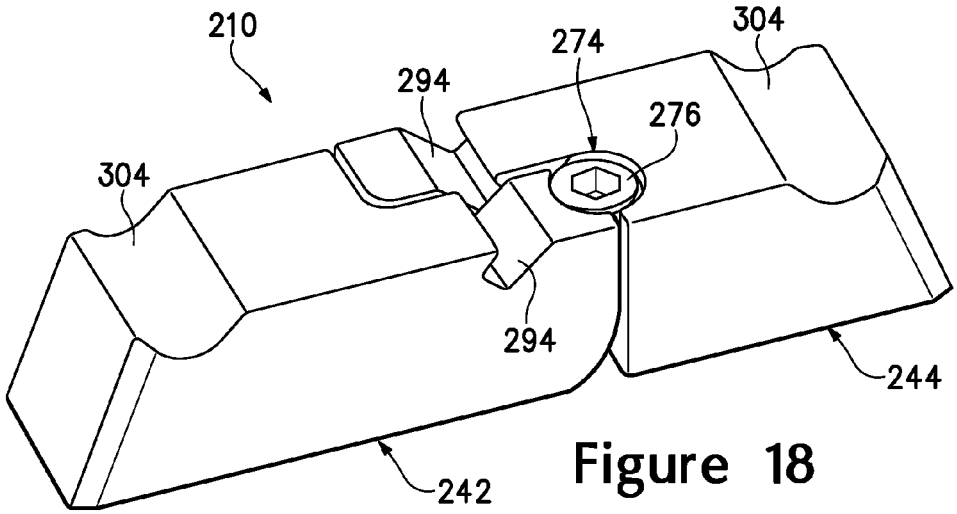
FIG. 18 is a perspective view of the second alternative lock in the retaining position.
Figure 19:
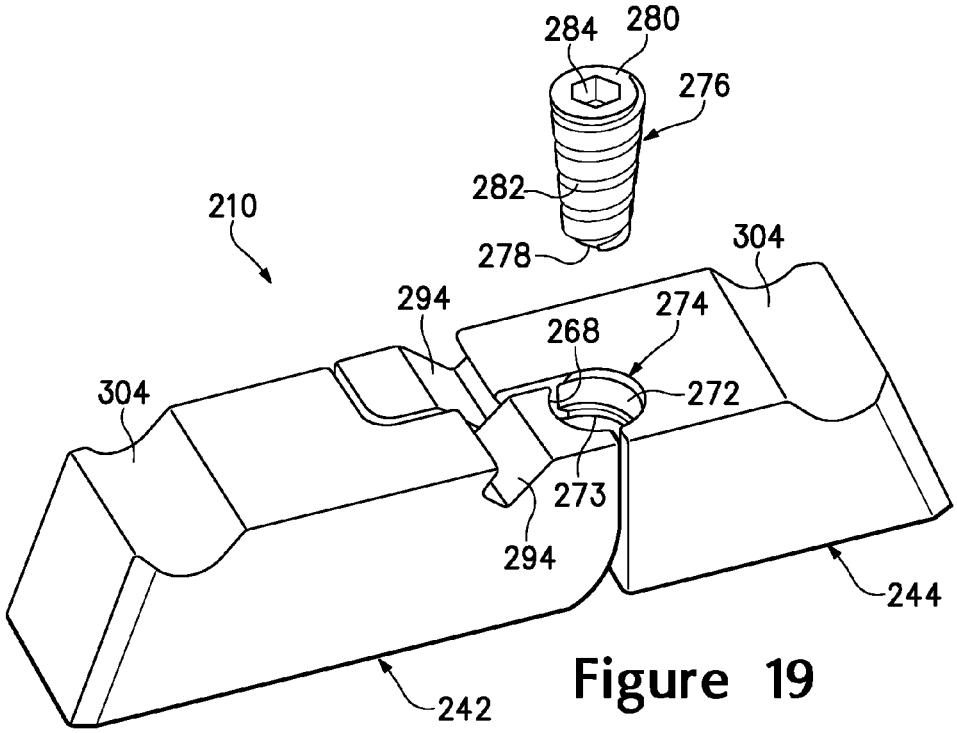
FIG. 19 is a perspective view of the second alternative lock with the retainer removed.
Figure 20:
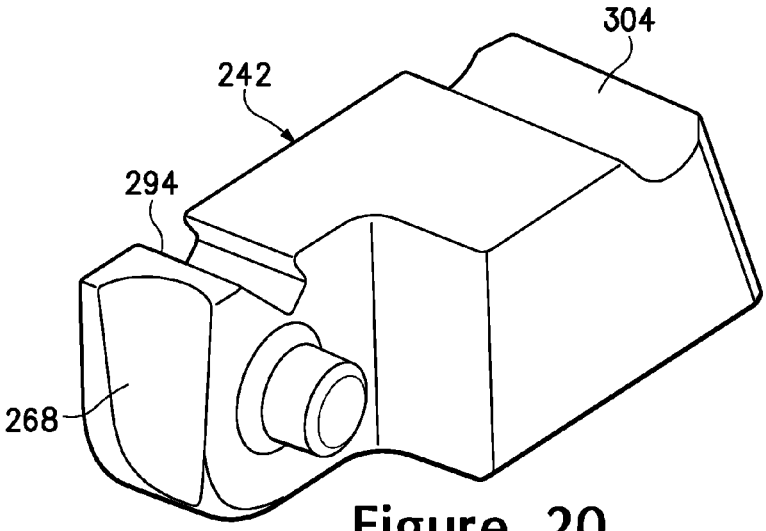
FIG. 20 is a perspective view of a first component of the second alternative lock.
Figure 21:
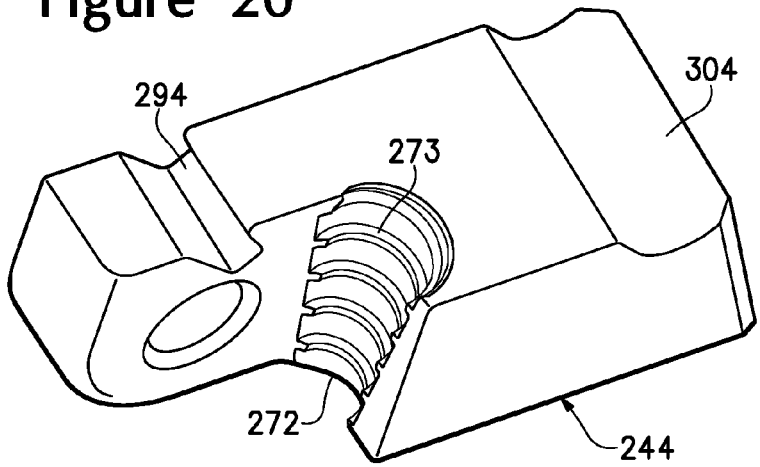
FIG. 21 is a perspective view of a second component of the second alternative lock.
Figure 22:
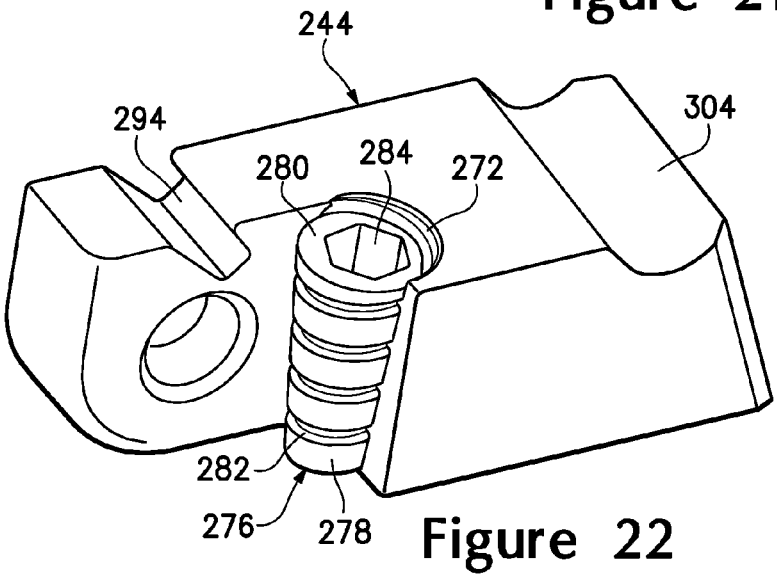
FIG. 22 is a perspective view of the second component of the lock with the retainer.

As an alternative, lock 110 (FIGS. 12-15) can be used to secure shroud 12 (or other wear members) to lip 16 (or other earth-working equipment) in place of lock 10. Locks 10 and 110 are generally the same except lock 110 includes a different retainer 176, and a driver 177 in place of grips 94. More specifically, lock 110 includes two bodies 142, 144 pivotally connected together for movement between a retaining position (FIG. 12) to hold the wear member to the equipment and a release position (FIG. 13) to permit installation and removal of the lock. Body 142 includes a post 156 that is received within hole 160 in body 144 to form hinge 164.

Post 156 includes a flat 157 that cooperates with retainer 176. In this embodiment, the retainer is a set screw received into a threaded passage 174 in projection 154; i.e., passage 174 extends between upper surface 179 and hole 160. In the retaining position, flat 157 sets generally perpendicular to passage 174 to enable set screw 176 to be tightened against the flat and thereby prevent relative movement between the bodies 142, 144. This arrangement eliminates the need to align channels 68, 72 for receipt of retainer 76, as in lock 10. Moreover, in this embodiment, the retainer can be retracted to permit release of the lock without removing the retainer. As a result, the lock remains an integral assembly in both the retaining and release positions. This benefit could also be gained for other retainers that simply extend into both bodies but are not inserted along the seam of the two lock bodies.

As an alternative to grips, lock 110 includes a driver 177 that moves the lock from the retaining position to the release position. Driver 177 eliminates the need for a separate prying tool 101 to remove the lock. In a preferred construction, driver 177 is a threaded rod received in through-hole 181 in body 142 proximate the middle of the lock. Although though-hole 181 is shown adjacent front face 180 it could be located in other parts of body 142 or 144. To remove lock 110, set screw 176 is first loosened or removed. Driver 177 is threaded downward through body 142 to press against a top of boss 26 and push the middle of lock 110 upward. This motion causes bodies 142, 144 to be pivoted about hinge 164 to their release position when the lock can be manually griped and removed.

Other combinations of features could be used together. For example, a lock with a set screw style retainer could be used with a lock having grips to facilitate engagement with a removal tool. Alternatively, a lock with a driver could be used with a retainer fit in a passage defined between the two bodies.

FIGS. 16-22 illustrate another alternative lock 210 which can be used to secure wear member 12 to the earth-working equipment. Lock 210 is similar to lock 10 except that retainer 276 is a threaded wedge having a form as disclosed in U.S. Pat. No. 7,174,661, which is incorporated by reference. Retainer 276 is a wedge with a narrow leading end 278 and a wide trailing end 280. The wedge is provided with a thread formation preferably in the form of a helical groove 282. A hex socket 284 or other means for turning the retainer is provided at trailing end 280.

Each body or component 242, 244 defines a channel 268, 272. Preferably only one channel 272 includes helical ridge segments 273 for engaging groove 282, but both channels 268, 272 could include such ridges. When bodies 242, 244 are assembled together in the retaining position, channels 268, 272 are aligned with each other to collectively form a tapered, threaded passage 274 adapted to matingly receive retainer 276. Lock 210 operates in essentially the same way as lock 10. Accordingly, lock 210 includes grips 294 and depressions 304 to facilitate use of tool 101. The use of a wedge retainer 276 over threaded rod 76 generally provides a more robust lock in the retaining position. The threaded wedge is also generally easier to remove.

Figure 23:
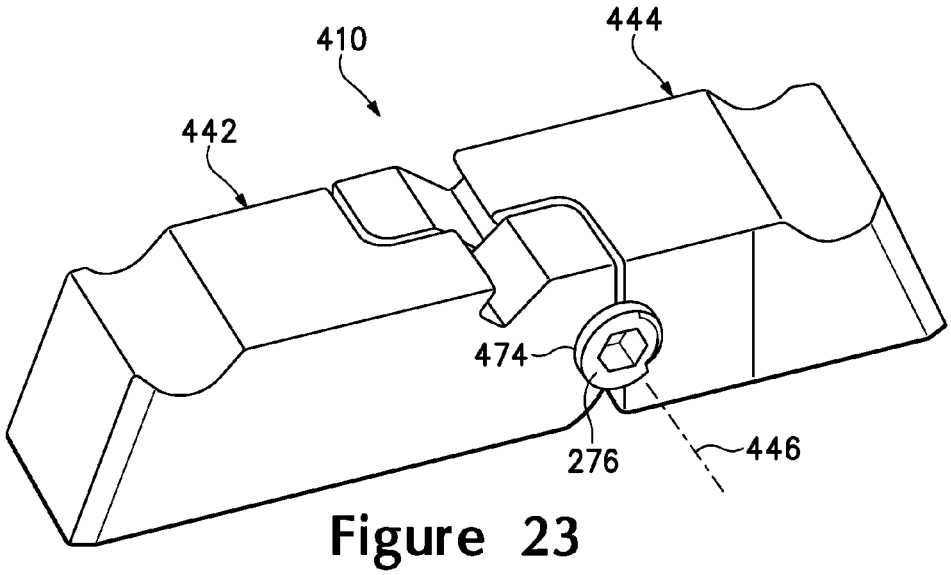
FIG. 23 is a perspective view of a fourth alternative lock in accordance with the present invention.
Figure 24:
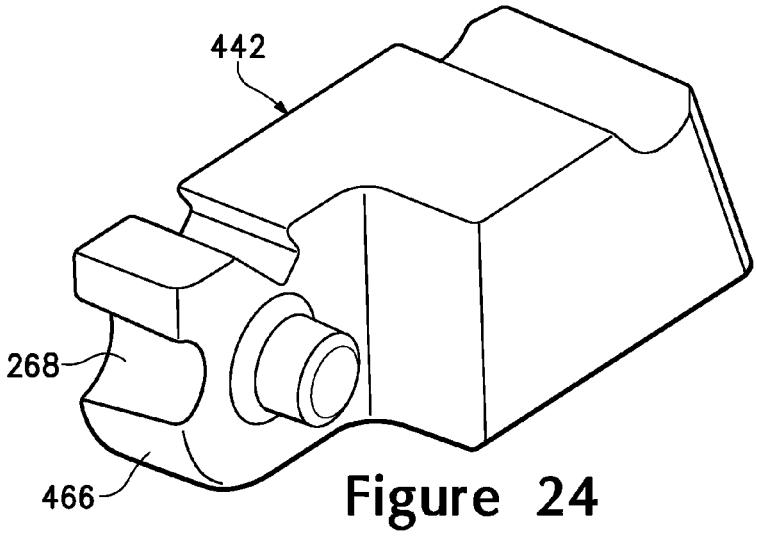
FIG. 24 is a perspective view of a first component of the fourth alternative lock.
Figure 25:
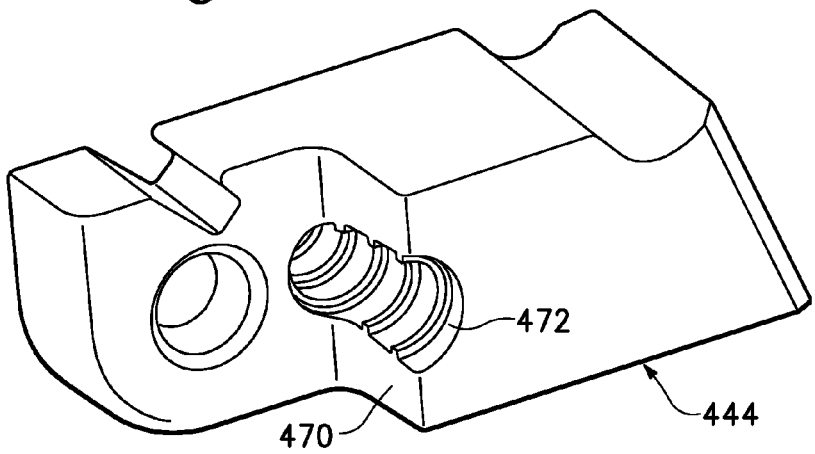
FIG. 25 is a perspective view of a second component of the fourth alternative lock.

As a further alternative, lock 410 can be secured in the retaining position by a retainer 276 that is horizontally driven between bodies 442, 444 (FIGS. 23-25). In lock 410, body 442 includes a tapered channel 468 that extends across end 466 in a direction that is generally parallel to axis 446. Similarly, body 444 includes a tapered channel 472 that extends across end 470 in a direction that is also generally parallel to axis 446. When bodies 442, 444 are in the retaining position (FIG. 23), channels 468, 472 form a tapering passage 474 that matingly receives retainer 276. As with lock 210, one channel 472 preferably includes helical ridge segments to engage groove 282. However, the channel may only be partially threaded or both channels may be threaded.

Threaded rod 76, threaded wedge 276 or set screw 176 could each be secured into the interconnected bodies in a direction parallel or transverse to the pivot axis. If the retainer is inserted in a horizontal direction, either parallel or perpendicular to the pivot axis, clearance (not shown) must be provided in the wear member to permit installation and removal of the retainer. As one example, the wear member could be formed with a generally T-shaped opening that opens in the rear wall of the wear member such as disclosed in U.S. Pat. No. 5,653,048.

The above-discussed embodiments are preferred embodiments of the present invention. Various alternatives could be used. For example, the retainers may be threaded rods or threaded wedges in any of the disclosed embodiments. The retainers may have considerably different constructions and include shifting plates, detents, latches, etc. The pivot axis or hinge may be defined in other ways that permit the desired movement of the bodies. Folding of the locking component could also be achieved by other means. In general, various other embodiments as well as many changes and alterations may be made without departing from the spirit and broader aspects of the invention as defined in the claims.

The invention claimed is:

1. A wear assembly for earth-moving equipment, the wear assembly comprising:

a detachable wear member for earth-moving equipment that protects the earth-moving equipment from wear caused by contact with abrasive materials encountered by operation of the earth-moving equipment, the wear member having an opening with an inlet; and a hammerless lock received through the inlet and into the opening in the wear member to releasably hold the wear member to the earth-moving equipment, the lock including (i) an elongate foldable element having a first end and a second end, the foldable element having a first position in which the foldable element has a first length extending the distance between the first and second ends, the first length being larger than the inlet of the opening so that the first and second ends of the foldable element extend beyond the inlet to retain the foldable element in the opening, the foldable element having one side for contacting the wear member and an opposite side for contacting the earth-moving equipment when in the opening to resist loads applied to the wear member during use that urge the wear member in a release direction so that the foldable element holds the wear member to the earth-moving equipment, and the foldable element having a second position in which the foldable element is folded relative to the first position and having a second length extending the distance between the first and second ends that is shorter than the first length, the second length being smaller than the inlet so that the lock is passed through the inlet for installation and removal of the lock to and from the opening without a hammer, and (ii) a retainer releasably engaging the foldable element when in the first position to prevent the foldable element from moving to the second position.

2. A wear assembly in accordance with claim 1 wherein the foldable element defines a passage into which the retainer is received.

3. A wear assembly in accordance with claim 1 wherein the foldable element includes two bodies joined together by a pivot pin.

4. A wear assembly in accordance with claim 1 wherein the foldable element includes a pair of discrete bodies interconnected for pivotal movement about a post defining a pivot axis.

5. A wear assembly in accordance with claim 4 wherein the bodies collectively define a passage between the two bodies to receive the retainer when in the retaining position.

6. A wear assembly in accordance with claim 5 wherein the passage and the retainer are each tapered and threaded to mate with each other.

7. A wear assembly for earth-moving equipment, the wear assembly comprising:

a wear member adapted to be mounted on the earth-moving equipment and to protect the equipment from wear caused by contact with abrasive materials encountered by operation of the earth-moving equipment, the wear member having an opening with an inlet; and a lock to be received through the inlet and into the opening in the wear member to releasably hold the wear member to the equipment, the lock including an elongate foldable element having a first end and a second end, the foldable element having a first position in which the foldable element has a first length extending the distance between the first and second ends, the first length being larger than the inlet of the opening so that the first and second ends of the foldable element extend beyond the inlet to retain the foldable element in the opening to hold the wear member to the equipment, and the foldable element having a second position in which the foldable element is folded relative to the first position and having a second length extending the distance between the first and second ends that is shorter than the first length, the second length being smaller than the inlet so that the lock can be passed through the inlet for installation and removal of the lock to and from the opening; and the lock including a retainer engaging the foldable element to selectively prevent folding of the foldable element from the first position to the second position, the foldable element defining a passage into which the retainer is received, and the passage and retainer each being threaded to mate with each other.

8. A wear assembly in accordance with claim 7 wherein the passage and retainer are each tapered.

9. A lock for receipt through an inlet and into an opening in a wear member to releasably hold the wear member to earth-moving equipment, the lock including an elongate foldable element having a first end and a second end, the foldable element having a first position in which the foldable element has a first length extending the distance between the first and second ends, the first length being larger than the inlet of the opening so that the first and second ends of the foldable element extend beyond the inlet to retain the foldable element in the opening to hold the wear member to the earth-moving equipment, and the foldable element having a second position in which the foldable element is folded relative to the first position and having a second length extending the distance between the first and second ends that is shorter than the first length, the second length being smaller than the inlet so that the lock can be passed through the inlet for installation and removal of the lock to and from the opening without a hammer, wherein the lock includes a retainer engaging the foldable element to selectively prevent folding of the foldable element from the first position to the second position, the lock includes two bodies joined together by a pivot pin, at least one of the bodies defines a passage into which the retainer is received, and the passage and retainer are each threaded to mate with each other.

10. A lock in accordance with claim 9 wherein the passage and retainer are each tapered.

11. A hammerless lock for releasably securing a wear member to earth-moving equipment, the lock comprising (i) a foldable element that pivots about a pivot axis between a retaining position where the foldable element holds the wear member to the equipment and a release position where the lock foldable element can be removed to permit removal of the wear member from the equipment each without a hammer, wherein the foldable element has a length in a direction transverse to the pivot axis that is greater in the retaining position than in release position, the foldable element having one side to contact the wear member and an opposite side to contact the earth-moving equipment to prevent the wear member from moving in a release direction relative to the earth-moving equipment, and (ii) a retainer operable to engage the foldable element in the retaining position to prevent movement of the foldable element to the release position.

12. A hammerless lock in accordance with claim 11 wherein the foldable element includes a pair of discrete bodies that collectively define a passage between the two bodies to receive the retainer when in the retaining position.

13. A hammerless lock in accordance with claim 12 wherein the passage and the retainer are each tapered and threaded to mate with each other.

14. A hammerless lock in accordance with claim 10 further including at least one grip for a tool to engage the foldable element to move the foldable element from the retaining position to the release position.

15. A hammerless lock in accordance with claim 11 wherein the foldable element includes a pair of bodies, wherein one of said bodies defines a post, and wherein the other of said bodies defines a hole for receiving the post to define the pivot axis.

16. A hammerless lock receivable through an inlet and into a larger an opening for releasably securing a detachable component to a base component of earth-moving equipment to accommodate replacement of the detachable component due to wearing, the lock comprising:

a foldable element manipulable between an extended position in which the foldable element is elongate and generally linear, and a folded position in which the foldable element is folded relative to the extended position into an angular configuration, the foldable element having a first end and an opposite second end such that a length of the foldable element is defined between the first and second ends, the length of the foldable element being smaller than the inlet when in the folded position so that the foldable element is passed through the inlet for installation and removal of the foldable element to and from the opening without a hammer, and the length being larger than the inlet in the extended position, the foldable element having one side for contacting the wear member and an opposite side for contacting the earth-moving equipment when in the opening to resist loads applied to the wear member during use that urge the wear member in a release direction so that the foldable element holds the wear member to the earth-moving equipment;

a grip on the foldable element to be engaged when the foldable element is in the opening to withdraw the foldable element from the opening through the inlet to facilitate removal of the detachable component; and a retainer releasably holding the foldable element in the extended position in the opening to hold the lock in the opening and thereby hold the detachable component to the base component during use.

17. A hammerless lock in accordance with claim 16 wherein the foldable element includes a pair of bodies secured together by a pivot element.

18. A hammerless lock in accordance with claim 17 wherein the bodies each include a channel to receive the retain to prevent the foldable element from moving from the folded position to the extended position.

19. An assembly for earth-moving equipment comprising:

a base component and a detachable component, the detachable component being removably secured to the base component to accommodate replacement of the detachable component due to wearing during use of the earth-moving equipment, wherein the base component and the detachable component fit together to collectively define a cavity, and the detachable component defining an inlet in communication with the cavity;

a foldable element manipulable between an extended position in which the foldable element is elongate and generally linear, and a folded position in which the foldable element is folded relative to the extended position into an angular configuration, the foldable element having a first end and an opposite second end such that a length of the foldable element is defined between the first and second ends, the length being larger than the inlet in the extended position and smaller than the inlet when in the folded position so that the foldable element is passed through the inlet for installation and removal of the foldable element to and from the cavity without a hammer, the foldable element having one side for contacting the wear member and an opposite side for contacting the earth-moving equipment when in the opening to resist loads applied to the wear member during use that urge the wear member in a release direction so that the foldable element holds the wear member to the earth-moving equipment;

a retainer releasably holding the foldable element in the extended position in the cavity to hold the foldable element in the cavity and thereby hold the detachable component to the base component during use; and a grip on the foldable element to be engaged when the foldable element is in the cavity to withdraw the foldable element from the cavity through the inlet to facilitate removal of the detachable component.

20. An assembly for earth-moving equipment comprising:

a base component and a detachable component that is removably secured to the base component to accommodate replacement of the detachable component due to wearing during use of the earth-moving equipment, wherein the base component and the detachable component fit together to collectively define a cavity, the cavity being generally inaccessible except for an inlet defined in the detachable component that communicates with the cavity;

a hammerless lock receivable in the cavity to hold the detachable component to the base component, the lock including a pair of bodies pivotally secured together for movement about a pivot axis between a retaining position and a release position, each of the bodies including an outer end that is remote from the pivot axis, wherein the outer ends define opposite ends of the lock, wherein the bodies are moved about the pivot axis to the release position such that outer ends of the bodies are drawn toward one another for installation of the lock through the inlet and into the cavity, the bodies being moved about the pivot axis in an opposite direction during installation such that the outer ends move away from each other in the cavity to extend beyond the bounds of the inlet, and the bodies being movable about the pivot axis toward each other in the cavity during removal of the lock from the cavity for passage and exit through the inlet without a hammer, the bodies collectively defining one side for contacting the wear member and an opposite side for contacting the earth-moving equipment when in the opening to resist loads applied to the wear member during use that urge the wear member in a release direction so that the bodies hold the wear member to the earth-moving equipment; and a retainer for contacting the bodies to hold the bodies in the retaining position to retain the lock in the cavity and thereby secure the detachable component to the base component.

21. A wear assembly in accordance with claim 20 wherein at least one of the bodies includes a grip to be engaged when the bodies are in the cavity to withdraw the foldable element from the cavity through the inlet to facilitate removal of the detachable component.

22. A hammerless lock for releasably securing a detachable component to earth-moving equipment to accommodate removal when the detachable component is worn, the lock comprising a pair of bodies interconnected for pivotal movement about a pivot axis between a retaining position and a release position, and a retainer operable to engage the bodies in the retaining position to prevent movement of the bodies to the release position, the lock being more compact in the release position as compared to the extended position such that the lock is passed through an inlet in the assembly for installation and removal without a hammer, and larger than the inlet in the retaining position so as to prevent removal of the lock from the assembly during use, the bodies being unencumbered and freely movable about the pivot axis when the retainer is not engaged for easy movement between the retaining and release positions, and for installation and removal of the lock without a hammer, the foldable element having one side for contacting the wear member and an opposite side for contacting the earth-moving equipment when in the opening to resist loads applied to the wear member during use that urge the wear member in a release direction so that the foldable element holds the wear member to the earth-moving equipment.

* * * * *